US007562783B2

(12) United States Patent
Bourreau et al.

(10) Patent No.: US 7,562,783 B2
(45) Date of Patent: Jul. 21, 2009

(54) FUNCTIONAL INSERT FOR THE NECK OF A RECIPIENT, ESPECIALLY A BOTTLE, AND CLOSING CAPSULE COMPRISING SAID INSERT

(75) Inventors: Jean-Marie Bourreau, Le Pizou (FR); Jacques Granger, Sainte Terre (FR)

(73) Assignee: Pechiney Capsules, Clichy (FR)

( * ) Notice: Subject to any disclaimer, the term of this patent is extended or adjusted under 35 U.S.C. 154(b) by 818 days.

(21) Appl. No.: 10/501,914

(22) PCT Filed: Feb. 7, 2003

(86) PCT No.: PCT/FR03/00383

§ 371 (c)(1),
(2), (4) Date: Sep. 22, 2004

(87) PCT Pub. No.: WO03/068624

PCT Pub. Date: Aug. 21, 2003

(65) Prior Publication Data

US 2005/0211655 A1 Sep. 29, 2005

(30) Foreign Application Priority Data

Feb. 12, 2002 (FR) ..... 02 01726

(51) Int. Cl.
*B65D 49/02* (2006.01)

(52) U.S. Cl. ..... 215/232; 215/21

(58) Field of Classification Search ..... 215/17, 215/18, 21, 232

See application file for complete search history.

(56) References Cited

U.S. PATENT DOCUMENTS

| | | | | |
|---|---|---|---|---|
| 4,248,748 | A * | 2/1981 | McGrath et al. | 524/271 |
| 5,045,569 | A * | 9/1991 | Delgado | 521/60 |
| 5,078,288 | A * | 1/1992 | Fuchs | 215/209 |
| 5,101,993 | A * | 4/1992 | Nairn et al. | 215/232 |
| 2003/0021919 | A1 | 1/2003 | Granger et al. | |

FOREIGN PATENT DOCUMENTS

| | | | |
|---|---|---|---|
| DE | 3618558 | | 12/1987 |
| EP | 185245 | | 6/1986 |
| GB | 2244691 | A * | 12/1991 |
| WO | 0000390 | | 1/2000 |

* cited by examiner

*Primary Examiner*—Anthony D Stashick
*Assistant Examiner*—James N Smalley
(74) *Attorney, Agent, or Firm*—Dennison, Schultz & MacDonald

(57) ABSTRACT

A functional insert including a body which is provided with at least one flexible flange on the outer surface thereof, for creating a tight connection with the neck, and a functional element. The functional insert is characterised in that: a) it includes an adhesive which is typically carried by the flange and is selected in such a way that it adheres to the neck of the recipient, and b) the adhesive is typically a permanent adhesive selected in terms of its consistency or viscosity such that it only squeezes out under stress. In this way, any axial displacement towards the top of the functional insert is prevented by fixing the body to the neck of the recipient by means of an adhesive contact region.

16 Claims, 2 Drawing Sheets

FUNCTIONAL INSERT FOR THE NECK OF A RECIPIENT, ESPECIALLY A BOTTLE, AND CLOSING CAPSULE COMPRISING SAID INSERT

This application is a filing under 35 USC 371 of PCT/FR2003/000383 filed on Feb. 7, 2003.

FIELD OF THE INVENTION

The invention relates to functional inserts to be placed in receptacle necks in order to make the said receptacle perform a specific function, namely typically a pouring spout function or a non-refilling function.

The invention also relates to closing caps in which this type of insert is fitted.

STATE OF THE ART

Many functional inserts to be placed in receptacle necks are already known, typically to perform a pouring spout function, or a non-refilling function, or possibly other functions.

Closing caps provided with sealing inserts are also known, as are these similar caps that also comprise functional inserts by means of a reversible assembly, so that the functional insert can be placed in the bottle neck at the same time as the closing cap is placed on the neck.

Thus, French application No. 99 14016 in the name of the applicant divulges a closing cap comprising a functional insert that forms a pouring spout.

Similarly, French application No. 00 00397 in the name of the applicant divulges a closing cap comprising a functional insert that forms a non-refilling function.

Documents DE 36 18 558 A1 and EP 0 185 245 A2 divulge inserts that can be glued to a neck.

Problems that Arise

Functional inserts according to the state of the art generally comprise circular ribs that provide a leak tight attachment of inserts in the neck, by virtue of their flexibility.

Functional inserts may be attached by force fitting the insert into the neck, which does not cause a problem when the functional insert is fixed separately and when it is adapted to a predetermined neck, and particularly when the neck has a "A" profile, in other words a significant narrowing in the axial direction from bottom to top, such that once the insert is force fitted into the neck, it cannot easily come out again.

However, attachment of the inserts causes problems when the neck has a "V" profile, in other words with the significant increase in diameter in the axial direction from the bottom to the top, such that there is a risk that the insert could come out of the neck once it has been placed inside it.

This risk is particularly significant if the necks have dimensional irregularities and if the functional insert is fixed to the neck at the same time as the closing cap. In this case, standard capping equipment is used and therefore capping does not include any specific force fitting step during assembly of the functional insert into the neck.

Therefore, the invention is designed to give good attachment of the functional insert to a neck, regardless of the neck profile, if it is a "A" or a "V" or if it is straight, also with larger tolerances on the inside dimensions of the necks, even when the functional insert is associated with a closing cap and is fixed to the neck when the cap is fitted on the neck as if the closing cap does not include a functional insert.

DESCRIPTION OF THE INVENTION

According, to the invention, the typically plastic functional insert for the typically glass bottle neck, comprises a body that will be inserted in the said neck, the said body supporting at least one flexible rib on its outside surface designed to form a sealed junction with the said neck when the said functional insert is inserted into the said neck, and a functional element, and is characterised in that:

a) the said functional insert comprises an adhesive supported on the said rib, typically on its upper surface, and/or on the said outer surface of the said body, the said adhesive being chosen to bond to the said neck, b) the said adhesive is a typically permanent adhesive chosen with a consistency or viscosity such that it will only creep under a stress that compresses the said adhesive between the said rib and the said body when, with the said functional insert being inserted into the said neck, the said rib retracts and its contents or quantity are chosen such that the said adhesive comes into contact with the said neck so as to solidarise the said body to the said neck at an adhesive contact area and to prevent axial displacement of the said functional insert in the upwards direction under axial stress.

The invention is based on the combination of several means:

- firstly, use of an adhesive with a rheology chosen so that there is no creep in the absence of mechanical stress, and such that there is no untimely flow of the adhesive which would be unacceptable in all cases;
- secondly, on the position of this adhesive, typically on a rib or at the bottom of the annular cavity formed between two ribs and the outside surface of the body of the insert, such that it is not accessible when the inserts are stored or are manipulated,
- furthermore, on the lack of contact between the adhesive and the contents of the bottle: since the lower rib on which this adhesive is located is a sealing rib or may be a sealing rib, the adhesive will not come into contact with the contents of the bottle,
- finally, on use of this adhesive in idle time; the action of positioning the insert in the neck (in the normal manner) triggers bending of the ribs upwards and consequently the necessary creep of the adhesive towards the neck.

The applicant has observed that with the means according to the invention, it is possible to considerably improve the resistance of functional inserts in necks, in industrial production and for all types of necks.

Firstly, it is easy to obtain a functional insert fixed to a neck with a "A" profile in the laboratory, however the situation is quite different in industrial production when manufacturing tolerances on the neck and on the functional insert can accumulate unfavourably, since each industrial part will be made within a variable dimensional range, with a relatively wide range for glass necks as a result of the technology specific to glass. Therefore, the invention provides a means of industrially obtaining inserts fixed to necks, despite the tolerances on the neck and on the insert, even when these tolerances are unfavourable, for example in the case of an insert with minimum dimensions and a neck with the maximum dimensions.

Moreover, the invention solves the problem of the variety of neck profiles, typically "A" profiles (favourable case for attachment of a functional insert) or "V" profiles tapered slightly outwards) unfavourable case for attachment of the functional insert.

In this special case, the invention provides a solution based on adhesion with a "chemical" bond between parts, which eliminates dependence on the precise shape of the neck, rather than a solution based on a "geometric" cooperation between parts to be fixed to each other.

Another advantage of the invention is that the problems that arise are solved essentially on the input side at insert manufacturers, rather than on the output side for example in cellars in which wine is bottled, and these bottles are then finally capped, such that capping processes and devices may remain unchanged when functional inserts are used according to the invention.

DESCRIPTION OF THE FIGURES

All figures relate to the invention and except for FIG. 5*a*, are total or partial axial sections along the axis (10) of the functional insert (3).

Figure 1:
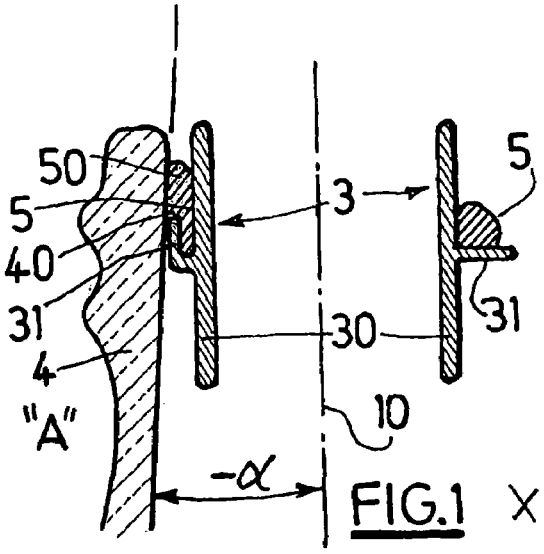
FIGS. 1 to 3 show only the body (30) of the functional insert (3) without its functional element (6, 7), for reasons of simplicity.

The right part of FIG. 1 illustrates a half-section of a functional insert (3) comprising a single rib (31) supporting the adhesive (5) before capping.

The left part of FIG. 1 illustrates cooperation of the same insert in a neck (4) of the "A" type (since its angle $\alpha$ is such that the neck is smaller near the top, after capping, folding of the rib (31) causing creep of the adhesive (5) and formation of an adhesive ring (50) in contact with the bottle at an adhesive contact area (40).

Figure 2:
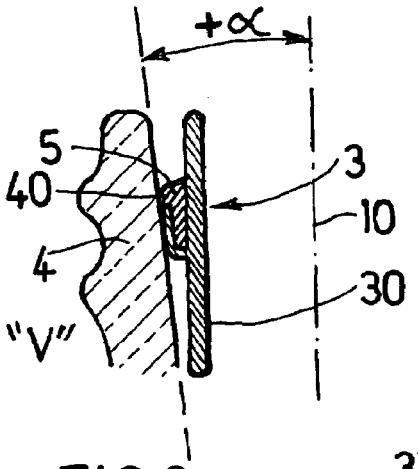

FIG. 2 is similar to the left part of FIG. 1. It is different in that the neck is a "V" type (since its angle $\alpha$ is such that the neck is larger near the top.

Figure 3:
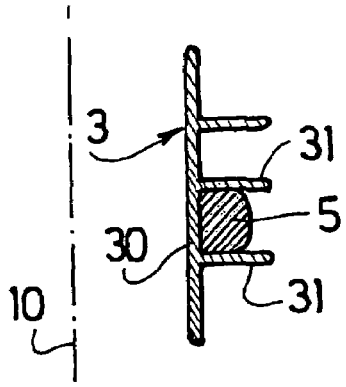

FIG. 3 is similar to the right part of FIG. 1. It is different in that the functional insert (3) comprises three ribs (31) and in that the adhesive (5) is located in the annular groove limited by two adjacent ribs and by the outer surface of the body (30) between these two ribs.

Figure 4:
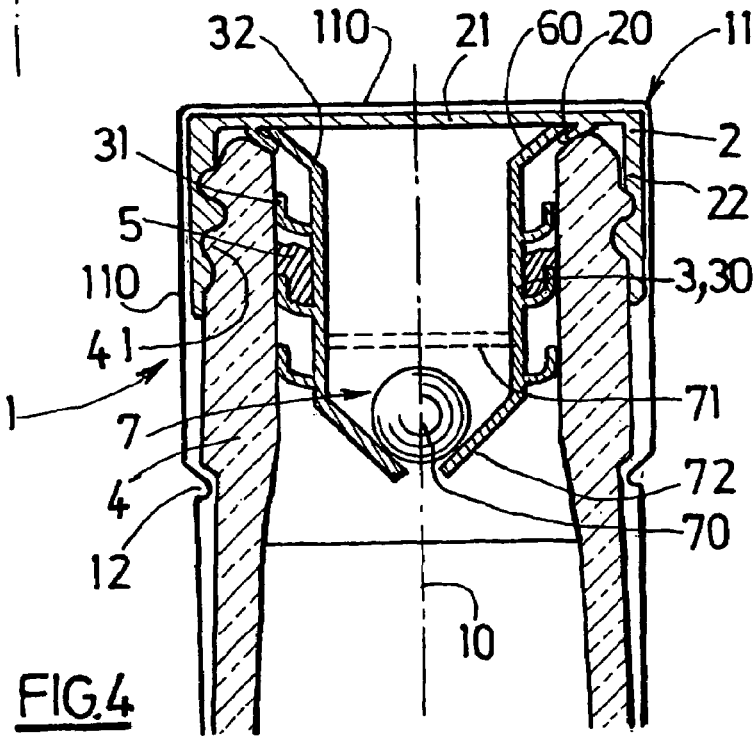

FIG. 4 illustrates the case of a cap (1) provided with a sealing insert (2) and a functional insert (3) of the non-fillability type (7), which is inserted inside a threaded neck (4).

FIGS. 5*a* to 7 illustrate the case of a cap (1) provided with a functional insert (3) of the pouring spout type (6).

DETAILED DESCRIPTION OF THE INVENTION

According to this invention, the said body (30), typically cylindrical, may comprise at least two ribs (31), the said adhesive (5) typically being placed between the two ribs, or on each rib. The presence of several ribs can simultaneously give better leak tightness, and axial centring of the body (30) with respect to the neck (4).

According to one variant of the invention, the said adhesive (5) may be in the shape of a ring, so as to form a circular or annular contact area around the entire inner circumference of the neck.

However, the said adhesive (5) may form one or several discontinuous deposits, so as to form a discontinuous or continuous contact area depending on the number of the said discontinuous deposits, typically between 1 and 4.

Apart from varying the diameter of the body (30), it is possible to vary the space between ribs and particularly the flexibility of the ribs to reduce the radial distance between the said body (30) and the inner surface of the neck (4)—radial distance that can thus vary from 0.1 to 0.6 mm, and thus to obtain an adhesive contact area (40) determined in advance and particularly a surface contact area as large as is required, so as to make the axial separation energy threshold of the functional insert (3) equal to the required value, the minimum value being the value that corresponds to the bottle being opened when the reversible assembly means (20) and (32) separate from each other.

According to the invention, the said adhesive (5) may be a permanent "hot-melt" type adhesive.

The adhesive (5) may possibly be an adhesive that can be activated or cross-linked, typically by the input of energy, once the said insert has been placed in the said neck. This adhesive may include a setting agent or activator.

Thus, adhesives capable of creeping under stress can be used for a given period of time, that typically set by natural aging after this period of time, this period of time being fairly long to be compatible with normal industrial and commercial practices, and thus to enable manufacturing of functional inserts according to the invention, marketing and finally attachment to necks. In this case, these inserts are products with a determined life, as happens very frequently in some domains and particularly in food processing or medicine.

The said adhesive (5) may also typically be in the form of micro-balls that release the said adhesive when the said functional insert (3) is placed in the said neck, or is an adhesive that can be activated when the said functional insert (3) is placed in the said neck.

Regardless of the type of adhesive chosen, the said adhesive (5) is chosen so as to typically bond to glass, or the neck material, and in which the contact area of the said adhesive contact area is typically between 20 and 500 $mm^2$, such that the said insert remains fixed in the said neck under an axial force equal to at least 0.5 daN and preferably at least 5 daN. In some cases, particularly when the adhesive sets either by ageing or setting triggered after the functional insert has been fixed in the neck, it may be impossible to separate the functional insert (3) from the neck (4) without the risk of destroying the neck itself, so as to prevent any risk of fraud.

According to one embodiment of the invention illustrated in FIGS. 5*a* to 7, the said functional element may form a pouring spout (6).

According to another embodiment of the invention illustrated in FIG. 4, the said functional element may form a non-filling device (7) or an anti-fraud device.

Figure 7:
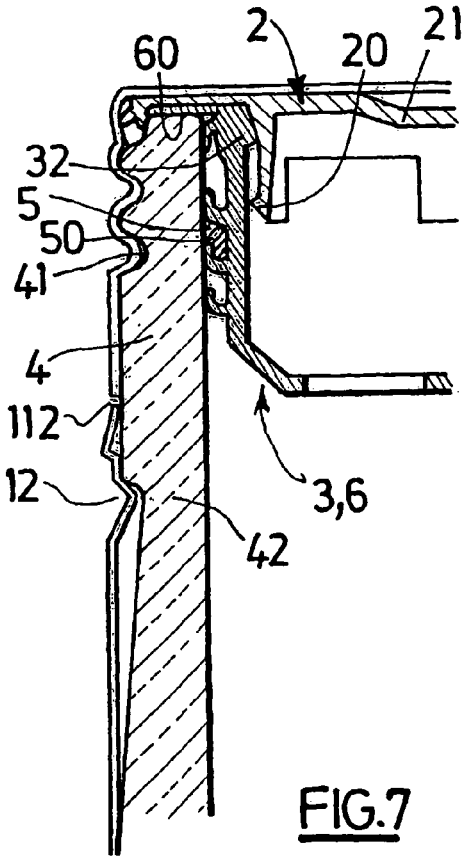
Figure 6:
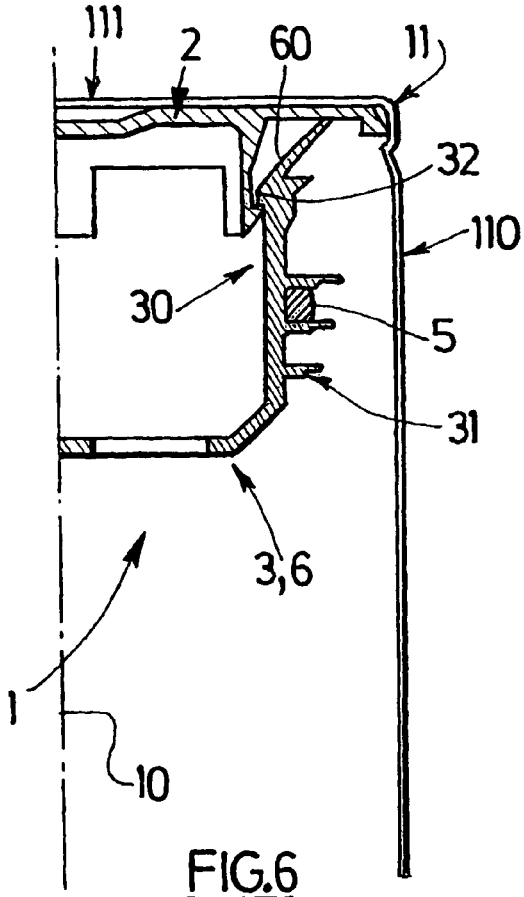

As illustrated in FIGS. 4, 6 and 7, the said functional insert (3) may comprise a reversible assembly means (32) that will temporarily fix the said functional insert (3) to a cap (1), typically a closing cap, or to a sealing insert (2) of the said cap, the said axial stress corresponding to at least the stress necessary to separate the said cap (1) or the said sealing insert (2) from the said functional insert (3) when the said cap is opened.

Another purpose of the invention consists of a cap (1), typically a closing cap, comprising a shell (11) provided with a skirt (110) and a sealing insert (2), possibly threaded, fixed to the said shell (11), and a functional insert (3) according to the invention, the said sealing insert (2) or the said shell (11) and the said functional insert (3) comprising reversible fixing means (20, 32), typically by reversible click fitting.

It is particularly advantageous according to the invention if the insert is fixed to the neck during capping of the neck itself, such that in practice, attachment of the insert takes place at the same time as the standard capping operation.

The said shell (11) may be metallic, typically made of aluminium, or plastic, and in this case it may be heat sealable.

Another purpose of the invention consists of a process for manufacturing a cap according to the invention in which:

a) the said functional insert (3), the said adhesive (5) and the said closing cap (1) typically fitted with the said sealing insert (2), are supplied, b) the said adhesive (5) is deposited or applied on the said functional insert (3), c) the said functional insert (3) is then fixed to the said sealing insert (2) or to the said shell (11), such that the said adhesive (5) is protected from any external contact by the skirt (110) of the said shell, and thus the said cap (1) may be manipulated without any risk of damage.

Finally, another purpose of the invention consists of the use of a functional insert (3) and/or a cap (1) comprising the said functional insert according to the invention, to fix any type of a functional element (6, 7) to any type of neck (4), either with a prismatic profile or an "A" or a "V" profile, regardless of its diameter varying from 18 mm to 45 mm, and typically about 30 mm.

EXAMPLE EMBODIMENTS

Functional inserts (3) and caps (1) were manufactured according to FIGS. 4 to 7, for standard 30 mm necks.

FIG. 4 illustrates the case of a functional insert (3) of the non-fillability type (7) inserted into a neck (4) with threads (41). This functional insert (3) was inserted with a closing cap (1) comprising a shell (11) and a sealing insert (2), the cap being shown screwed and crimped by irreversible deformation (12) under the ring (42) of the neck. This sealing insert includes a head (21), a threaded skirt (22) and reversible assembly means (20) cooperating with the flexible lip (60) forming the reversible assembly means (32) of the functional insert (3). The functional insert (3) comprises three ribs (31) as shown in FIG. 3 and a non-fillability device (7), comprising a ball (70) free to move between a stop grid (71) and a support (72) provided with a central orifice.

FIGS. 5*a* to 7 illustrate the case of a functional insert (3) of the pouring spout type (6).

Figure 5C:
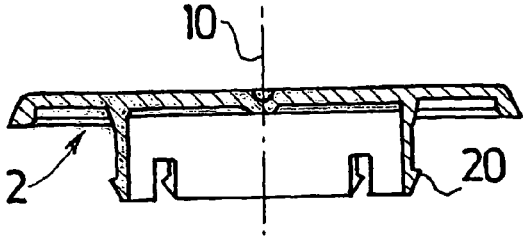
Figure 5B:
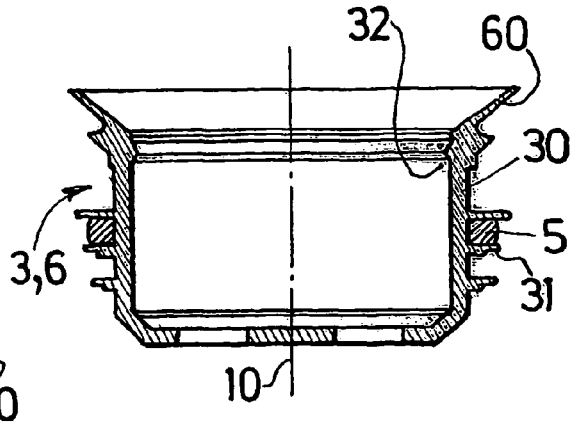
Figure 5A:
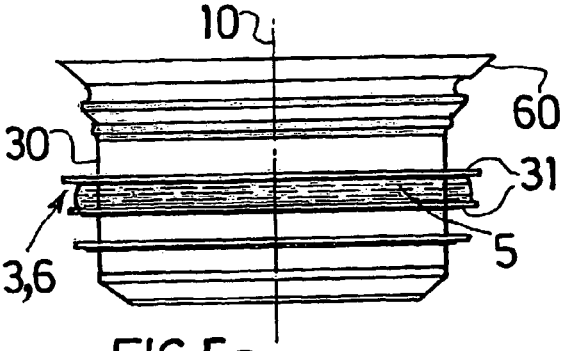

FIG. 5*a* is a side view of the functional insert (3) including the said adhesive (5) between two ribs, while FIG. 5*b* is a sectional view.

FIG. 5*c* is a view of the sealing insert (2) provided with a reversible assembly ring (20) designed to cooperate with the edge (32) of the functional insert (3) by reversible click fitting.

FIG. 6 shows a right half-section showing the assembly consisting of the reversible assembly of the closing cap (1) consisting of a typically metallic shell (11) with a skirt (110) and a head (111) fixed to a sealing insert (2), and the functional insert (3,6).

FIG. 7 shows the entire FIG. 6 in a left half-section, after crimp fitting of the cap onto the threaded neck.

To carry out these tests, the first step was to make aluminium shells (11) by stamping, and sealing inserts (2) and functional inserts (3), with 3 ribs made by moulding (injection) of PE or PP depending on the tests.

The adhesive used was a commercially available hot-melt adhesive, namely Plastoflex® 9092 or 9117 made by the Paramelt Company.

The next step was to use a spray gun with a heated nozzle to apply an adhesive bead between the two top ribs, while rotating the insert with respect to the fixed nozzle. The quantities deposited in the tests varied from 0.01 to 0.5 g per insert.

Finally, functional inserts containing adhesive (5) were assembled in the sealing inserts (2) fixed to the shells (11) so as to obtain closing caps (1) according to the invention.

These caps (1) were used to cap different types of necks, particularly "A" and "V" profile necks. It was checked on the sections that the adhesive ring (50) illustrated in FIGS. 4 to 7 covered about 200 $mm^2$ in all cases.

In all cases, the force necessary to separate the functional insert (3) from the neck was more than 1 daN, and therefore much more than the normal separation force when the cap (1) is unscrewed and the sealing insert (2) separates from the functional insert (3).

ADVANTAGES OF THE INVENTION

The invention economically solves all the problems that arise. It also opens up an opportunity to make a new product family that can provide the consumer with increased security, particularly in the case in which the adhesive used sets and irreversibly fixes the functional insert to the neck and in the case in which this functional insert is of the non-filling type.

LIST OF MARKS

- Closing cap 1
  - Cap centreline 10
  - Shell 11
    - Skirt 110
    - Head 111
    - Tab or line of weakness 112
- Sealing insert 2
  - Reversible assembly means with 3 20
  - Head 21
  - Threaded skirt 22
- Functional insert 3
  - Body 30
  - Rib 31
  - Reversible assembly means with 1 or 2 32
- Neck 4
  - Adhesive contact area 40
  - Threading 41
  - Ring 42
- Adhesive 5
  - Adhesive ring 50
- Functional element=pouring spout 6
  - Flexible lip 60
- Functional element=non-filling device 7
  - Ball 70
  - Stop grid 71
  - Support for ball 70 with orifice 72

The invention claimed is:

1. Functional insert for insertion into the neck of a bottle through an opening, comprising:

a body constructed and arranged for insertion into the neck by force fitting, the body comprising a cylindrical wall having a central axis coincident with the central axis of the neck when the body is inserted into the neck, and normal to the opening, the cylindrical wall defining an outer surface, with at least one flexible rib on the outer surface extending radially outwardly with respect to the central axis, for forming a sealed junction with an inner surface of the neck when the body is inserted into the neck, the rib including an upper surface, a functional element, and an adhesive supported on at least one of the upper surface of the rib and the outer surface of the wall above the upper surface of the rib, the adhesive selected to bond to the neck and having a consistency or viscosity such that the adhesive will only creep under a stress that compresses the adhesive between the rib and the body when, with the body inserted into the neck, the rib curls, the adhesive being present in an amount sufficient that the adhesive comes into contact with the neck so as to fix the body to the neck at an adhesive contact area and thereby prevent upward axial displacement of the body under axial stress.

2. Insert according to claim 1, wherein the cylindrical wall comprises at least two ribs, the adhesive being disposed between two ribs, or on each rib.

3. Insert according to claim 1, wherein the adhesive forms a ring, such that the contact area is circular.

4. Insert according to claim 1, wherein the adhesive forms a plurality of discontinuous deposits, so as to form a plurality of discontinuous continuous contact areas.

5. Insert as claimed in claim 1, wherein the adhesive is a permanent, hot-melt adhesive.

6. Insert as claimed in claim 1, wherein the adhesive is activatable or crosslinkable, once the insert has been placed in the said neck.

7. Insert according to claim 6, wherein the adhesive includes a setting agent or activator.

8. Insert as claimed in claim 1, wherein the adhesive is in the form of micro-balls that release the adhesive when the functional insert is placed in the neck, or is an adhesive that is activated when the functional insert is placed in the neck.

9. Insert as claimed in claim 1, wherein the adhesive is bondable to glass, and wherein the contact area of the adhesive is between 20 and 500 $mm^2$, such that the insert remains fixed in the neck under an axial force equal to at least 0.5 daN.

10. Insert as claimed in claim 1, wherein the functional element forms a pouring spout.

11. Insert as claimed in claim 1, wherein the functional element forms an anti-refill device or an anti-fraud device.

12. Insert as claimed in claim 1, additionally comprising a reversible assembly means for temporarily fixing the functional insert to a cap or to a sealing insert of a cap, the axial stress corresponding to at least the stress necessary to separate the cap or the sealing insert from the functional insert when the cap is opened.

13. Closing cap comprising a shell provided with a skirt and a sealing insert fixed to the shell, and a functional insert according to claim 1 wherein the sealing insert or the shell and the functional insert comprises complementary reversible fixing means.

14. Closing cap according to claim 13, wherein the shell is metallic or is made of plastic.

15. Method for manufacturing a cap according to claim 13, comprising the steps of:

a) supplying the functional insert, the adhesive and the closing cap, b) depositing or applying the adhesive on the functional insert, and c) fixing the functional insert to the sealing insert or to the shell, such that the adhesive is protected from any external contact by the skirt of the shell, enabling the cap to be manipulated without risk of damage.

16. Insert as claimed in claim 1, comprising a plurality of said flexible ribs, with adhesive disposed on at least one of the upper surface of at least one of the ribs and the outer surface of the wall above the upper surface of at least one of the ribs.

* * * * *